US007575487B2

(12) United States Patent
Yodogawa

(10) Patent No.: US 7,575,487 B2
(45) Date of Patent: Aug. 18, 2009

(54) ELECTRIC CONNECTOR

(75) Inventor: Akihiro Yodogawa, Tokyo (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 12/155,616

(22) Filed: Jun. 6, 2008

(65) Prior Publication Data

US 2008/0305695 A1 Dec. 11, 2008

(30) Foreign Application Priority Data

Jun. 7, 2007 (JP) ..... P2007-151573

(51) Int. Cl.
*H01R 4/48* (2006.01)

(52) U.S. Cl. ..... 439/830

(58) Field of Classification Search ..... 439/830, 439/834, 246, 249, 950, 310, 374, 342, 345, 439/259, 260

See application file for complete search history.

(56) References Cited

U.S. PATENT DOCUMENTS 3,231,848 A * 1/1966 Ruehlemann ..... 439/637
3,953,096 A * 4/1976 Williams ..... 439/62
5,597,332 A * 1/1997 Walbrecht ..... 439/850
5,709,574 A * 1/1998 Bianca et al. ..... 439/858
6,113,440 A * 9/2000 Fijten et al. ..... 439/862
6,193,567 B1 * 2/2001 Hsieh ..... 439/853
6,511,336 B1 1/2003 Turek et al. ..... 439/249
6,848,952 B2 * 2/2005 Norris ..... 439/751
7,140,895 B2 * 11/2006 Tuin et al. ..... 439/246
7,393,216 B2 * 7/2008 Masaki et al. ..... 439/81
2002/0048999 A1 4/2002 Ming-Hui ..... 439/660
2002/0098743 A1 * 7/2002 Schell et al. ..... 439/850

FOREIGN PATENT DOCUMENTS

JP 2006-019296 1/2006

* cited by examiner

*Primary Examiner*—Alexander Gilman
(74) *Attorney, Agent, or Firm*—Morgan, Lewis & Bockius LLP

(57) ABSTRACT

An electric connector includes: a soldering portion, to be soldered to a substrate, and extending in a first direction; a rising portion, one end of which is connected to one end of the soldering portion, and extending in a second direction perpendicular to the first direction; an elastic portion, one end of which is connected to the other end of the rising portion, and including at least one bending part; and a receiving portion, adapted to receive a plug, and having a U-shape including an open end and a closed end, the open end provided with contact parts which are opposed to each other in a third direction perpendicular to the first and second directions, the closed end connected to the elastic portion. The soldering portion, the rising portion, the elastic portion and the receiving portion are integrally formed with each other.

18 Claims, 9 Drawing Sheets

ELECTRIC CONNECTOR

BACKGROUND OF THE INVENTION

The present invention relates to a small electric connector which is used for electric connection of electronic equipment and into which a plug terminal is inserted for such electric connection.

For detachable attachment of a battery pack to electronic equipment, a type of an electric connector that enables the battery pack to be electrically connected with and disconnected from electronic equipment is generally used. As an example of such a technique, an electric connector is disclosed in JP-A-2006-19296. This related-art technique disclosed in JP-A-2006-19296 is such that a plug receiving portion of sheet metal into which a plug terminal is inserted is formed on a base member via a spring member with an integrated manner. In describing the construction thereof in detail, the sheet metal is bent in a thickness direction into a substantially U-shape on both lateral external sides of the plug receiving portion, and each distal end of the sheet metal which is bent into the substantially U-shape is bent further in the thickness direction into a substantially U-shape on a lateral external side thereof, so as to form the spring member, and a lower end portion at a distal end of the spring member is bent in the thickness direction, so as to form the base member. This base member is fixed to a substrate by means of soldering. In this configuration, the spring member is elastically deformed in the thickness direction, and the bend of the substantially U-shaped bent portion is deformed, whereby the plug receiving portion can easily be shifted laterally to both sides thereof. Then, when the plug terminal is inserted into or removed from the plug receiving portion, even though the plug terminal is offset in a lateral direction relative to the plug receiving portion, thereby exerting a lateral force on the plug receiving portion, the lateral force so exerted is absorbed by the elastic deformation of the spring member, and no large lateral force is exerted on the base member which is fixed to the substrate. Therefore, there is caused no such an accident that the base member is separated from the substrate.

In electronic equipment such as a small mobile phone, in many cases, a plurality of such electric connectors are provided in such a manner as to be aligned horizontally. When the related art described in JP-A-2006-19296 is applied to such alignment of connector, the overall width or lateral dimension of the plug receiving portion has to be increased to quite a large extent, since the spring members are provided on both the lateral external sides of the plug receiving portion. Thus, the related-art technique described in JP-A-2006-19296 is not suitable for a configuration in which electric connectors are aligned at small intervals. This constitutes a cause for hindrance to the miniaturization of electronic equipment such as the mobile phone for which miniaturization is strongly demanded.

SUMMARY

It is therefore an object of the invention to provide an electric connector with a plug receiving portion having a reduced lateral dimension so that the overall length of the alignment connector is decreased.

In order to achieve the object, according to the invention, there is provided an electric connector, comprising:

a soldering portion, to be soldered to a substrate, and extending in a first direction;

a rising portion, one end of which is connected to one end of the soldering portion, and extending in a second direction perpendicular to the first direction;

an elastic portion, one end of which is connected to the other end of the rising portion, and including at least one bending part; and a receiving portion, adapted to receive a plug, and having a U-shape including an open end and a closed end, the open end provided with contact parts which are opposed to each other in a third direction perpendicular to the first and second directions, the closed end connected to the elastic portion, wherein the soldering portion, the rising portion, the elastic portion and the receiving portion are integrally formed with each other.

The open end of the receiving portion may be opened in the second direction.

The closed end of the receiving portion may be connected to the other end of the elastic portion. The other end of the elastic portion may extend in the first direction.

The elastic portion may include two of the bending parts so as to have an S-shape.

A width of the one end of the elastic portion may be greater than a width of the other end of the elastic portion in the third direction.

The elastic portion may be formed with a first slit so as to be divided into two pieces.

The rising portion may be formed with a second slit connected to the first slit.

The elastic portion maybe disposed between the receiving portion and the rising portion in the first direction.

The soldering potion may be formed with a projecting part capable of being in contact with the closed end of the receiving portion.

The closed end of the receiving portion may be formed with an engagement part extending in the second direction. The soldering portion may be provided with a projecting part capable of being in contact with the engagement part.

The open end of the receiving portion may be opened in the first direction.

The electric connector may further include a restricting portion, having a U-shape covering the receiving portion.

The elastic portion may be formed with a first slit so as to be divided into two pieces.

The rising portion may be formed with a second slit connected to the first slit.

The elastic portion may be disposed between the receiving portion and the rising portion in the first direction.

The other end of the elastic portion may extend in the first direction. The soldering potion may be formed with a projecting part capable of being in contact with the other end of the elastic portion.

The other end of the elastic portion may be formed with an engagement part extending in the second direction. The soldering potion may be formed with a projecting part capable of being in contact with the engagement part.

According to the invention, there is provided a connector unit incorporating a plurality of the electric connector arranged on the substrate in the third direction.

BRIEF DESCRIPTION OF THE DRAWINGS

FIG. 3A is a plan view, FIG. 3B is a front view and FIG. 3C is a right side view of the electric connector.

DETAILED DESCRIPTION OF PREFERRED EMBODIMENTS

Figure 1:
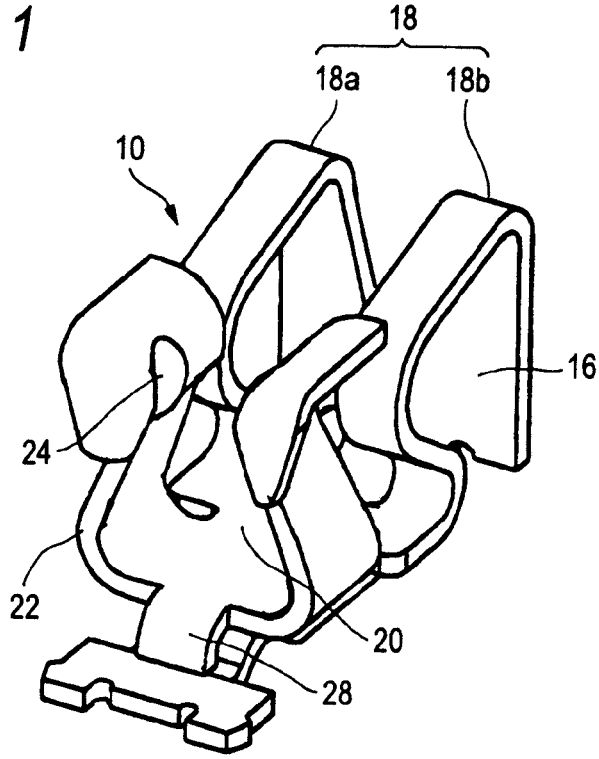
FIG. 1 is an external perspective view of an electric connector of a first embodiment of the invention as viewed from a forward obliquely upward position.
Figure 2:
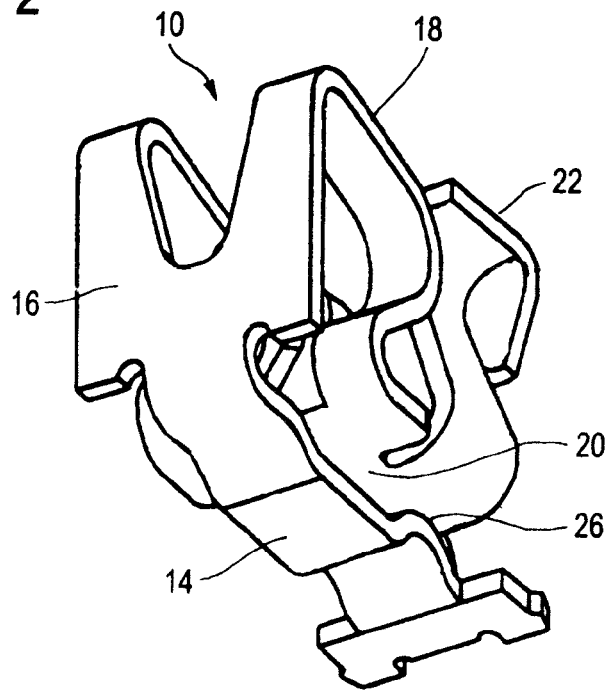
FIG. 2 is an external perspective view of the electric connector in FIG. 1 as viewed from a rearward obliquely downward position.
Figure 3A:
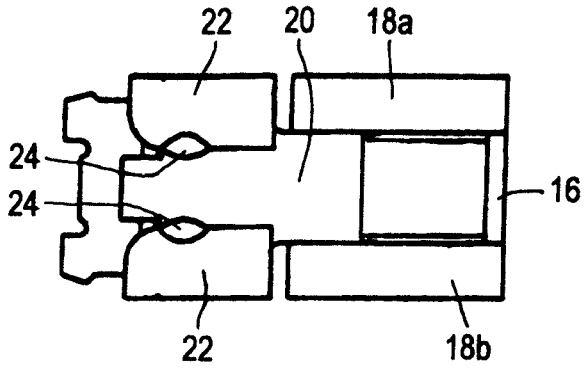
FIGS. 3A, 3B and 3C are three-plane drawings of the electric connector in FIG. 1.
Figure 3B:
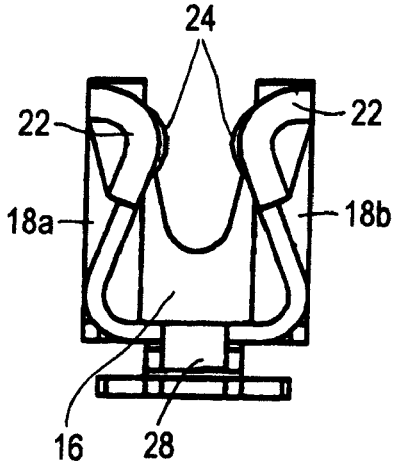
Figure 3C:
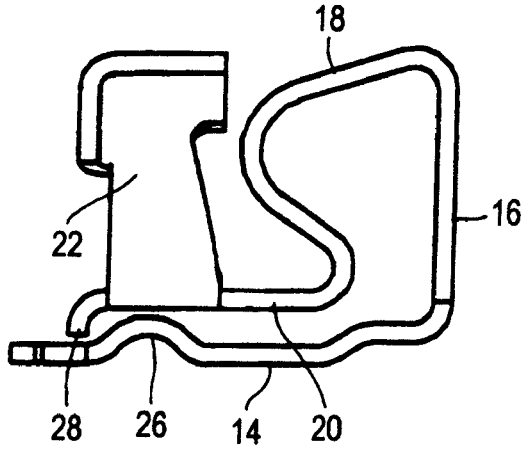

Hereinafter, a first embodiment of the invention will be described by reference to FIGS. 1 to 10.

Firstly, as is shown in FIGS. 1 to 3C, in a first embodiment of the invention, an electric connector 10 is made of a sheet material having conductivity and elasticity, and a rising portion 16 is formed by bending the sheet material at one end (a rear end as viewed from the front) of a soldering portion 14 which is to be placed on a surface of a substrate 12, which will be described later, so as to be fixed thereto by means of soldering in a thickness direction in such a manner as to be directed upwards of the substrate at substantially right angles to the surface of the substrate 12. The sheet material is bent further at an upper end of the rising portion 16 in the thickness direction towards the other end (a front end as viewed from the front) of the soldering portion so as to form a first elastic portion 18. The first elastic portion 18 is bent in the thickness direction into a substantially S-shape as viewed from a side thereof, and the sheet material is made to be directed substantially forwards again at a distal end of the first elastic portion 18 and is dimensionally narrowed in a width-ward or lateral direction so as to form a second elastic portion 20 which is substantially parallel to the substrate 12 (note that in this first embodiment, the length of the second elastic portion 20 is short). Furthermore, both lateral sides of the sheet material is bent in the thickness direction into a substantially U-shape or a substantially angular U-shape in such a manner as to define an opening above the substrate so as to form a plug receiving portion 22 at a distal end of the second elastic portion 20. Contact portions 24 which project inwards are provided, respectively, on surfaces of confronting lateral sides of this plug receiving portion 22. In addition, an upper edge and a front edge of the plug receiving portion 22 are formed into a curved surface which expands outwards. Furthermore, a longitudinal slit is provided on a portion of the sheet material which extends from an upper portion of the rising portion 16 to the first elastic portion 18 laterally centrally thereof so that the portion in question is divided into two parallel elastic pieces 18*b*, 18*b*. In addition, a projecting portion 26 which projects upwards is formed at the other end of the soldering portion 14, and an extended portion of the sheet material which is extended further forwards from a part of a front end portion of the plug receiving portion 22 is bent downwards in the thickness direction, so as to form an engagement portion 28. In addition, as is shown in the side view of FIG. 3C, the electric connector 10 is formed in such a manner that a certain space is provided between a bottom portion and the projecting portion 26 of the plug receiving portion 22 and that the engagement portion 28 lies further forwards than the projecting portion 26.

Figure 4:
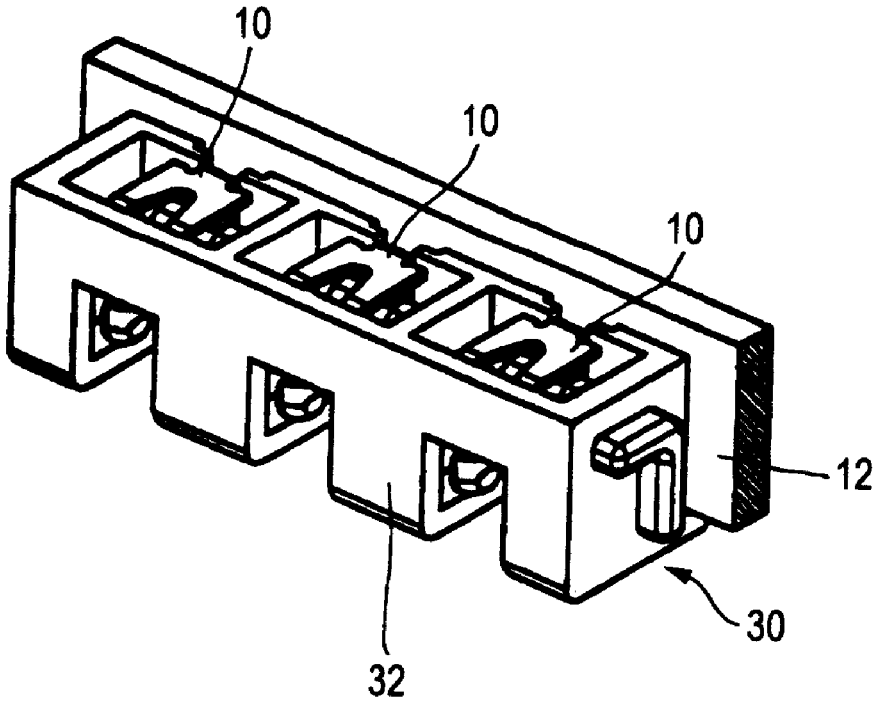
FIG. 4 is an external perspective view of a connector unit which is made up by aligning horizontally three electric connectors like the electric connector shown in FIG. 1.
Figure 5:
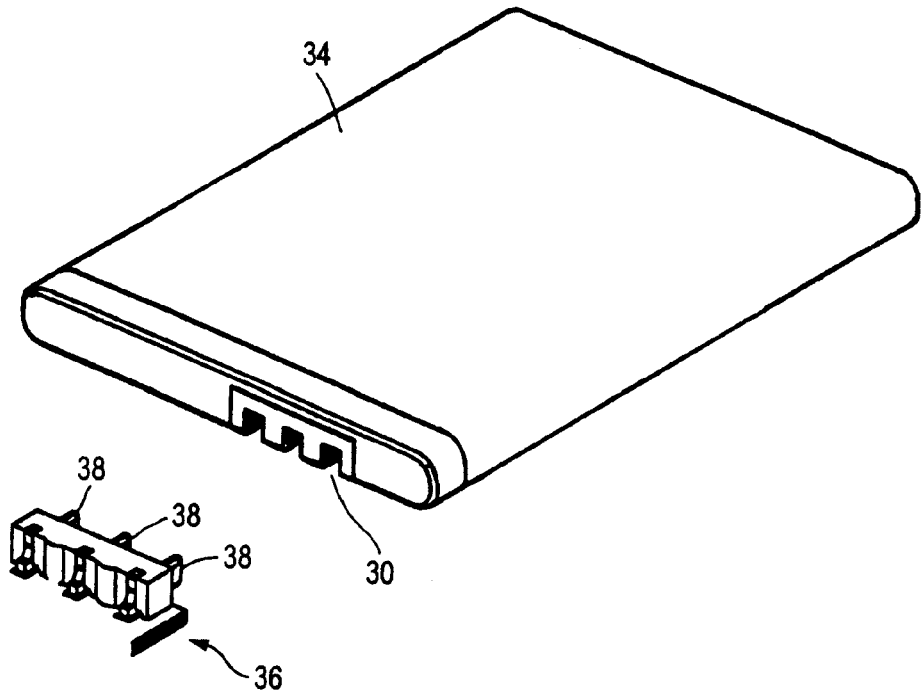
FIG. 5 is an external perspective view of a battery pack in which the connector unit in FIG. 4 is packaged and a plug terminal unit which is inserted into the connector unit.
Figure 6:
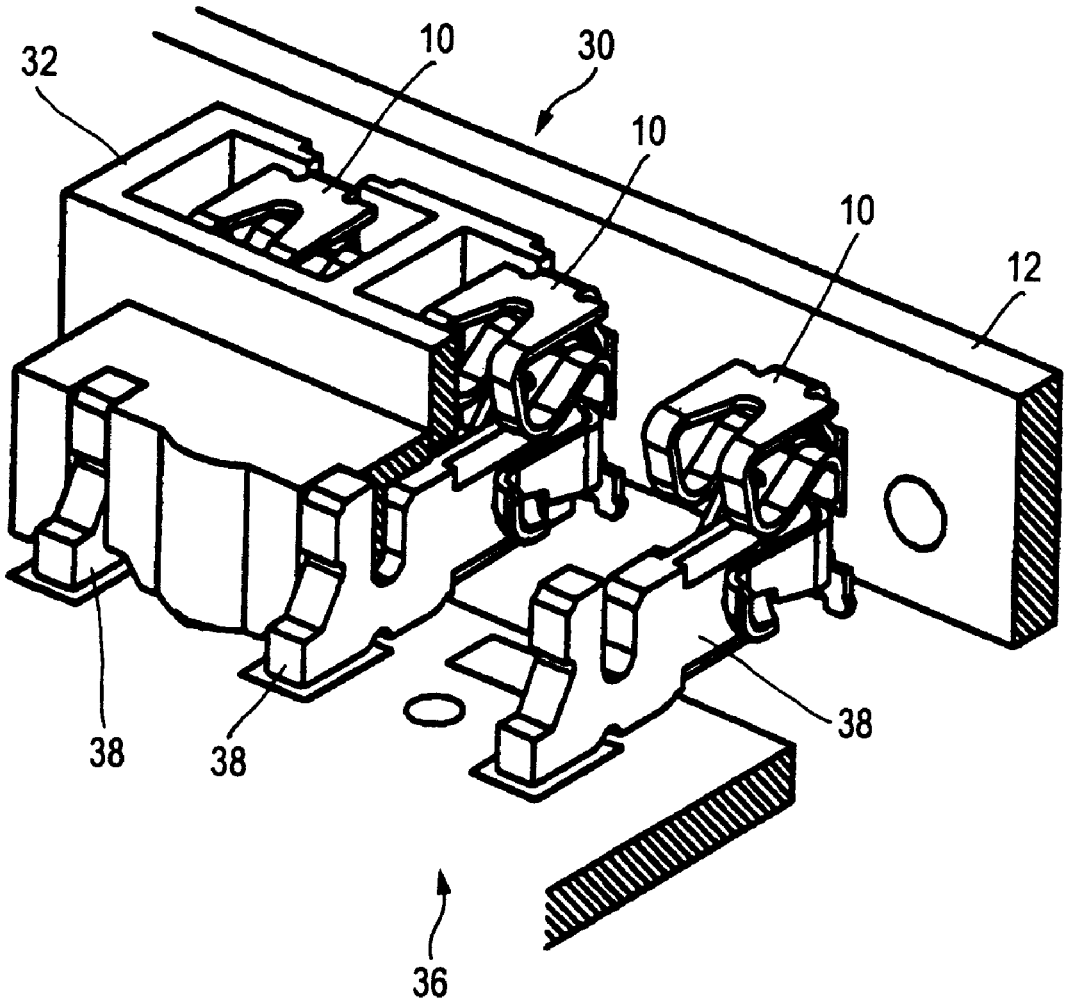
FIG. 6 is an external perspective view showing a state in which the plug terminal unit is inserted in the connector unit with a casing of the plug terminal unit partially cut away.
Figure 7A:
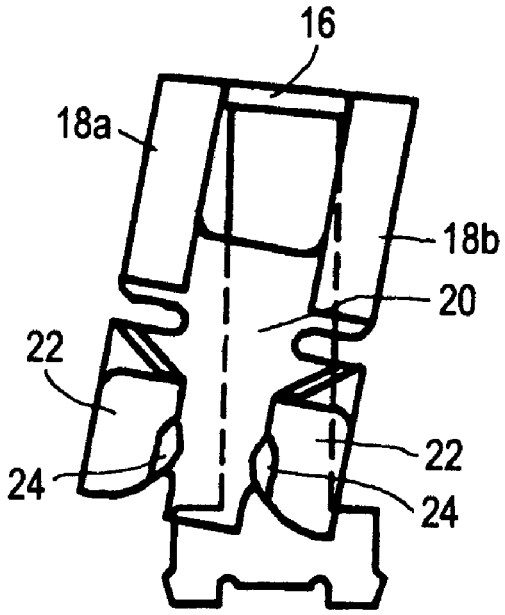
FIGS. 7A and 7B are drawings illustrating a leftward displacement of a plug receiving portion which occurs when a plug terminal inserted into the electric connector is offset to the left as viewed in the figure relative to the electric connector.
Figure 7B:
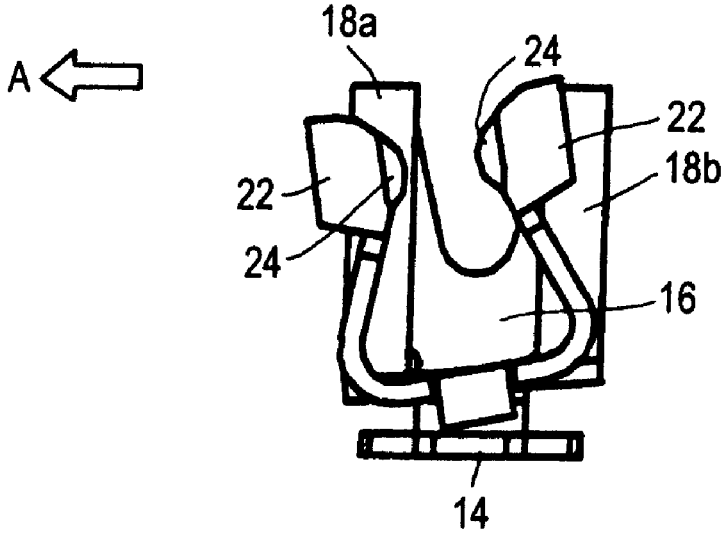

In the first embodiment that is configured as has been described above, as is shown in FIG. 4, three electric connectors 10 are aligned horizontally on the substrate 12 and soldering portions 14 of these electric connectors are fixed to the substrate 12 by means of soldering, whereby a connector unit 30 is made up. In FIG. 4, reference numeral 32 denotes a cover, made from an insulating resin, which is adapted to cover the electric connectors 10 and is, of course, provided with holes opened to face plug receiving portions 22 for allowing plug terminals 38 to be inserted into their corresponding plug receiving portions 22. Then, as is shown in FIG. 5, this connector unit 30 is incorporated in a battery pack 34, as an example, and this battery pack 34 is made to be attached to and detached from electronic equipment such as a mobile phone, whereby plug terminals 38 of a plug terminal unit 36 which is installed in the electronic unit can individually be inserted into their corresponding plug receiving portions 22 of the electric connectors 10 of the connector unit 30.

When the plug terminals 38 of the plug unit 36 are individually inserted into the plug receiving portions 22 of the electric connector 10, particularly in the event that the plug terminals 38 and the plug receiving portions 22 are positioned properly relative to each other, the plug receiving portions 22 are elastically deformed in such a manner that their substantially U-shapes or substantially angular U-shapes are slightly opened so as to permit the insertion of the plug terminals 38 thereinto. In this case, no particular force which attempts to shift the plug receiving portions 22 in the lateral direction is exerted thereon, there will be caused no problem. In reality, however, the battery pack 34 is not always installed in a predetermined position relative to the plug terminals 38, and in many cases, the battery pack 34 is installed in such a state that it is offset relative to the plug terminals 38. In the state where the battery pack 34 is installed to be offset relative to the plug terminals 38, the plug receiving portions 22 need to be elastically deformed in such a way as to match the offset so as to absorb it. This is because, in the event that the offset is not absorbed, a force attributed to the offset is exerted between the soldering portion 14 and the substrate 12, thereby causing a fear that the solder portion 14 is separated from the substrate 12 to disturb the ensured electric connection.

Then, in the electric connector 10 of the invention, an elastic displacement of the contact portions 24 of the plug receiving portion 22 relative to the soldering portion 14 due to the offset of the plug terminal 38 will be described by reference to FIGS. 7A to 8B. Firstly, in FIGS. 7A and 7B, a case will be described in which the plug terminal 38 is offset to the left as viewed in the figure relative to the electric connector 10. A direction of the offset is indicated by an arrow A in FIG. 7B. To absorb the offset, as viewed from the front, the left contact portion 24 may only have to be displaced to the left relative to the soldering portion 14. Then, in the first elastic portion 18, the right elastic piece 18*b* is elastically displaced in such a way that its distal end is positioned slightly forwards and upwards, while the left elastic piece 18*a* is elastically displaced in such a way that its distal end is positioned slightly rearwards and downwards. In addition, in FIG. 7A, the whole of the rising portion 16 is slightly twisted clockwise about an axis which is perpendicular to a surface of a sheet of paper on which the figure is drawn, and in FIG. 7B, the portion extending towards the front of the first elastic portion 18 is twisted as a whole slightly counterclockwise about an axis perpendicular to a surface of the sheet of paper on which the figure is drawn. Furthermore, in FIG. 7A, the substantially S-shaped portion of the first elastic portion 18 which so looks as viewed from the side thereof is twisted as a whole slightly clockwise about an axis perpendicular to the surface of the sheet of paper on which the figure is drawn, and moreover, in FIG. 7B, the second elastic portion 20 is twisted counterclockwise about an axis perpendicular to the surface of the sheet of paper on which the figure is drawn. By a series of these actions, the plug receiving portion 22 can be shifted to the left relative to the soldering portion 14 through the torsion of the rising portion 16, the first elastic portion 18 and the second elastic portion 20, as well as the elastic deformation of the first elastic portion 18 due to extension and contraction thereof, whereby the offset of the plug terminal 38 can easily be absorbed.

Figure 8A:
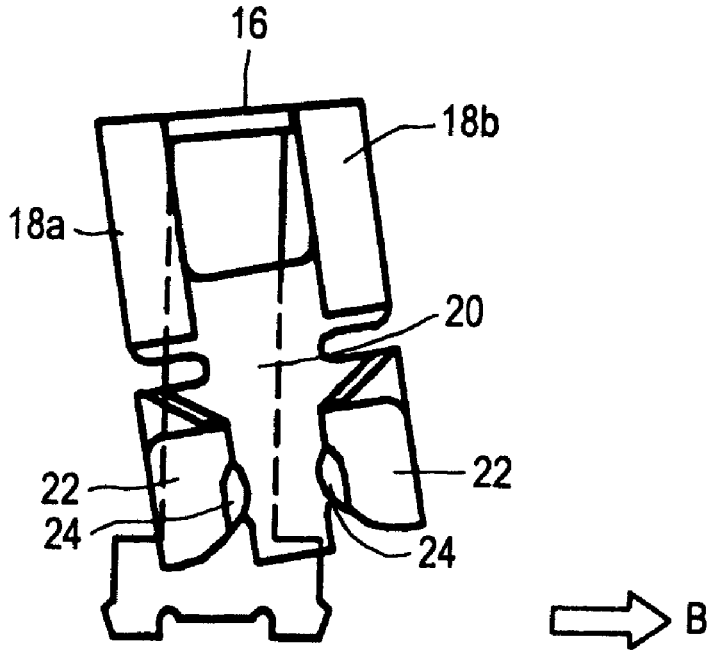
FIGS. 8A and 8B are drawings illustrating a rightward displacement of the plug receiving portion which occurs when the plug terminal inserted into the electric connector is offset to the right as viewed in the figure relative to the electric connector.
Figure 8B:
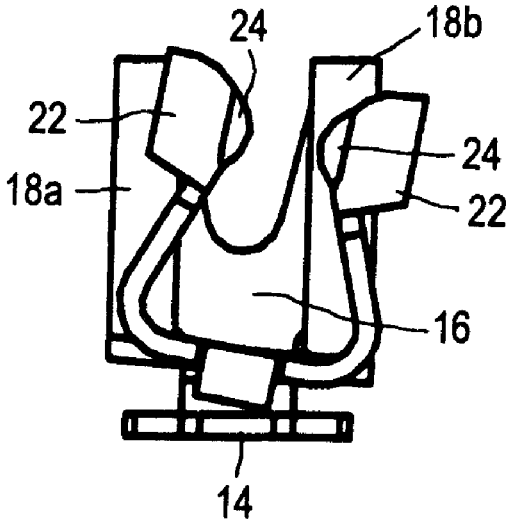

In addition, in FIGS. 8A and 8B, a case will be described in which the plug terminal 38 is offset to the right as viewed in the figure relative to the electric connector 10. A direction of the offset is indicated by an arrow B in FIG. 8A. To absorb the offset, as with the case described by reference to FIGS. 7A and 7B, as viewed from the front, the right contact portion 24 may only have to be displaced to the right relative to the soldering portion 14. Then, in the first elastic portion 18, the right elastic piece 18*b* is elastically displaced in such a way that its distal end is positioned slightly rearwards and downwards, while the left elastic piece 18*a* is elastically displaced in such a way that its distal end is positioned slightly forwards and upwards. In addition, in FIG. 8A, the whole of the rising portion 16 is slightly twisted counterclockwise about an axis which is perpendicular to a surface of a sheet of paper on which the figure is drawn, and in FIG. 8B, the portion extending towards the front of the first elastic portion 18 is twisted as a whole slightly clockwise about an axis perpendicular to a surface of the sheet of paper on which the figure is drawn. Furthermore, in FIG. 8A, the substantially S-shaped portion of the first elastic portion 18 which so looks as viewed from the side thereof is twisted as a whole slightly counterclockwise about an axis perpendicular to the surface of the sheet of paper on which the figure is drawn, and moreover, in FIG. 8B, the second elastic portion 20 is twisted clockwise about an axis perpendicular to the surface of the sheet of paper on which the figure is drawn. By a series of these actions, the plug receiving portion 22 can be shifted to the right relative to the soldering portion 14 through the torsion of the rising portion 16, the first elastic portion 18 and the second elastic portion 20, as well as the elastic deformation of the first elastic portion 18 due to extension and contraction thereof, whereby the offset of the plug terminal 38 can easily be absorbed.

Figure 9:
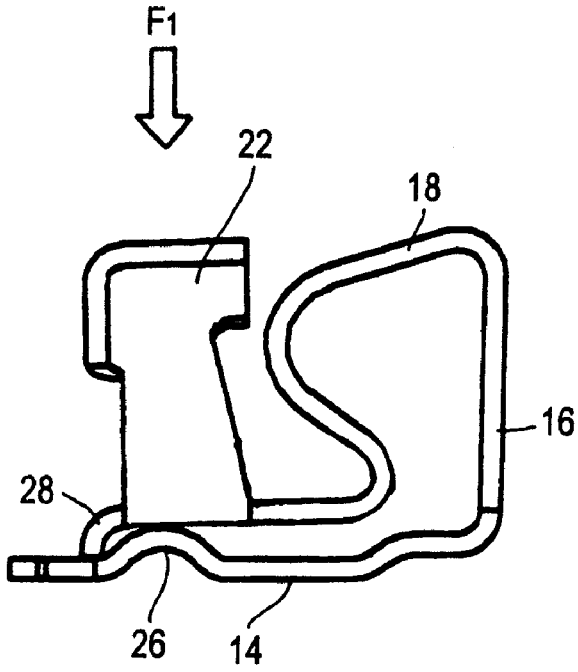
FIG. 9 is a drawing illustrating the restriction of an excessive elastic downward displacement of the plug receiving portion.
Figure 10:
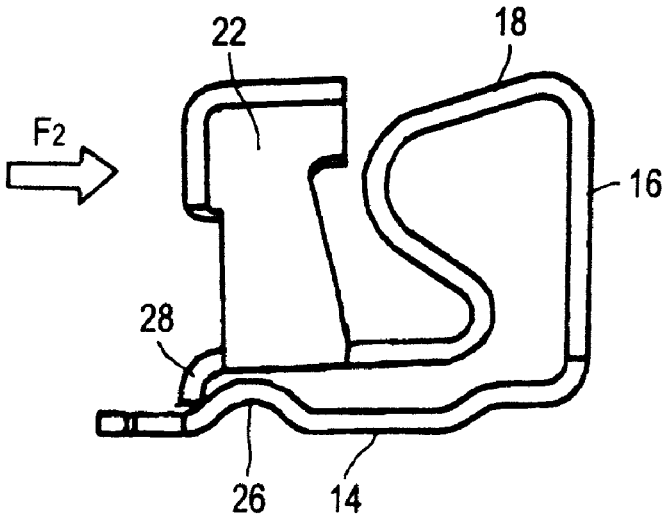
FIG. 10 is a drawing illustrating the restriction of an excessive elastic displacement of the plug receiving portion to one side of a soldering portion.

Furthermore, in inserting the plug terminal 38, as is shown in FIG. 9, when an excessive force indicated by an arrow F1 and directed vertically downwards relative to the substrate 12 is exerted on the plug receiving portion 22, the plug receiving portion 22 is elastically displaced downwards, and the bottom portion thereof comes into abutment with the projecting portion 26, whereby a further elastic displacement of the plug receiving portion 22 is restricted. Thus, there is caused no such a situation in which plastic deformation is caused by an excessive elastic deformation of the plug receiving portion 22. In addition, in inserting the plug terminal 38, as is shown in FIG. 10, when an excessive force indicated by an arrow F2 and directed rearwards in substantially parallel with the substrate 12 is exerted on the plug receiving portion 22, while the plug receiving portion 22 is elastically displaced rearwards, the engagement portion 28 provided at the distal end thereof comes into abutment with the projecting portion 26, whereby a further elastic displacement of the plug receiving portion 22 is restricted. Thus, there is caused no such a situation in which plastic deformation is caused by an excessive s elastic deformation of the plug receiving portion 22.

The electric connector 10 of the invention is configured and operates as has been described heretofore and is suitable for an application in which the plug terminal 38 is inserted from above substantially vertically and from the front obliquely. In addition, since the construction which can shift the plug receiving portion 22 laterally relative to the soldering portion 14 is provided entirely behind the plug receiving portion 22 as viewed from the front and no structural portion is provided which projects laterally outwards from both the external sides of the plug receiving portion 22, the lateral dimension of the electric connector 10 can be made small. Then, even when the plurality of electric connectors 10 are aligned horizontally on the substrate 12, the intervals at which the electric connectors 10 are so aligned may only have to be small. Consequently, the lateral dimension of the connector unit 30 is allowed to be small, and hence, the electric connector 10 of the first embodiment is suitable for miniaturization thereof.

Figure 11:
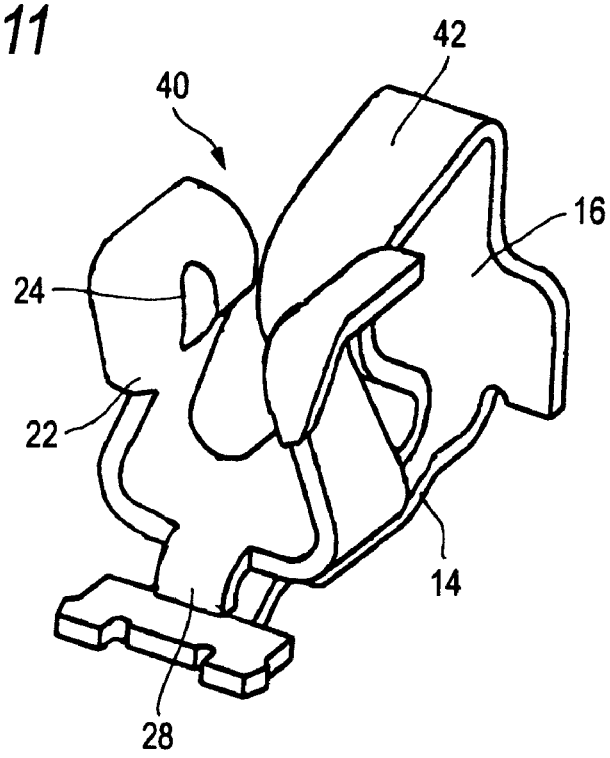
FIG. 11 is an external perspective view of an electric connector of a second embodiment of the invention as viewed from a forward obliquely upward position.

Next, a second embodiment of the invention will be described by reference to FIG. 11. In FIG. 11, like reference numerals will be imparted to like members to those described in FIGS. 1 to 10, and a repeated description thereof will be omitted here. In FIG. 11, an electric connector 40 of the second embodiment differs from that of the first embodiment in that a first elastic portion 42, which is formed by bending a sheet material in a thickness direction towards the front at a portion upwards of a rising portion 16, is made up of a single narrow elastic piece. In this second embodiment, a plug portion 22 is elastically displaced in a lateral direction mainly through torsion of the first elastic portion 42.

Figure 12:
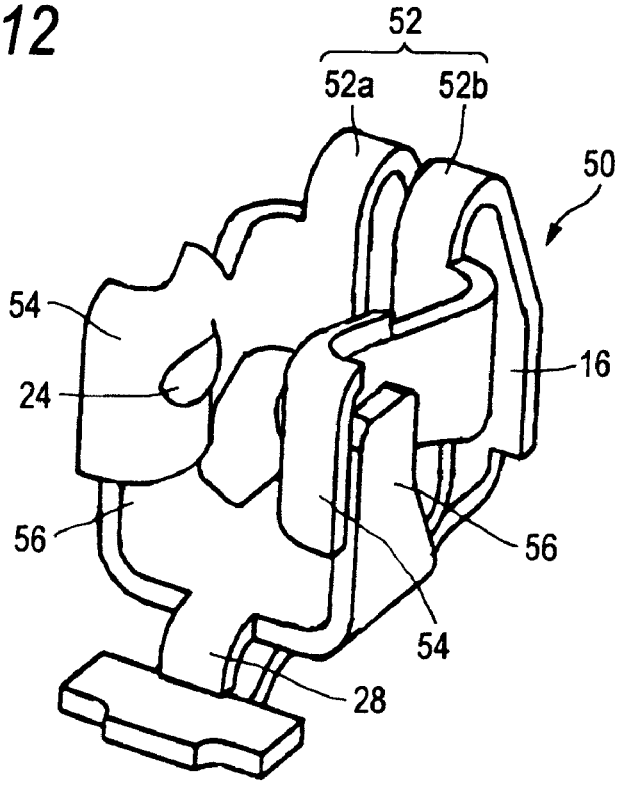
FIG. 12 is an external perspective view of an electric connector of a third embodiment of the invention as viewed from a forward obliquely upward position.

Furthermore, a third embodiment of the invention will be described by reference to FIG. 12. In FIG. 12, like reference numerals will be imparted to like members to those described in FIGS. 1 to 10, and a repeated description thereof will be omitted here. In FIG. 12, in an electric connector 50 of the third embodiment, a first elastic portion 52 is formed by bending a sheet material in a thickness direction into a substantially U-shape at a portion upwards of a rising portion 16, and a slit is provided laterally centrally in a portion of the sheet material which extends from part of an upper portion of the rising portion 16 to the first elastic portion 52, whereby the first elastic portion 52 is divided into two parallel elastic pieces 52*a*, 52*b*. Furthermore, a plug receiving portion 54 of a substantially U-shape or substantially angular U-shape is formed from intermediate portions along downward lengths of the two elastic pieces 52*a*, 52*b* in such a manner as to define an opening at the front thereof, and contact portions 24 which project inwardly are formed on both confronting sides of the plug receiving portion 54. Furthermore, the sheet material is bent forwards in the thickness direction at a lower portion of the plug receiving portion 54 so as to form an extended portion, and both lateral sides of the sheet material are bent upwards in the thickness direction at a portion of the extended portion which is formed substantially parallel to a soldering portion 14 so as to form a substantially U-shaped or substantially angular U-shaped restricting portion 56 in such a manner as to be made to open upwards. Inner surfaces of confronting sides of the restricting portion 56 are formed in such a manner as to be brought into contact, respectively, with outer surfaces of confronting sides of the plug receiving portion 54, or as to be positioned to confront the outer surfaces of the plug receiving portion 54 with an appropriate space defined therebetween. That is, the plug receiving portion 54 is covered by the restricting portion 56. Furthermore, the sheet material is extended further forwards at a distal end of part of the restricting portion 56 and the extended portion is then bent downwards so as to form an engagement portion 28.

The electric connector 50 of the third embodiment of the invention which is configured as has been described above is suitable for an application in which a plug terminal 38 is inserted in a substantially parallel direction with a substrate 12. In addition, the substantially U-shape or substantially angular U-shape of the plug receiving portion 54 is opened by the elastic pieces 52*a*, 52*b* being twisted in association with a relative lateral offset of the plug terminal 38, whereby the contact portions 24 are also offset in the lateral direction, whereby the relative offset of the inserted plug terminal 38 can be absorbed. Moreover, the opening of the substantially U-shape or the like of the plug receiving portion 54 due to its elastic deformation is restricted by the restricting portion 56 as required, whereby there is caused no situation in which a plastic deformation is generated by an excessive opening of the plug receiving portion 54.

While in the embodiments, the sheet material is bent towards the soldering portion 14 at the upper portion of the rising portion 16 so as to form the elastic portion 18, 42, 52, the invention is not limited to the configuration, and hence, although a depth dimension of the electric connector becomes long, the sheet material may be bent towards an opposite side to the soldering portion 14 at the upper portion of the rising portion 16 to form the elastic portion 18, 42, 52. In addition, it will suffice that a plurality of electric connectors 10 of the invention may be aligned on the substrate 12 of the connector unit 30, and hence, the number of electric connectors to be so aligned is, of course, not limited to three.

According to an aspect of the invention, the contact portions of the plug receiving portion can easily be displaced in the lateral direction by virtue of torsion and elastic deformation of the rising portion and the elastic portion which connect together the soldering portion and the plug receiving portion. Thus, the lateral offset of the plug terminal relative to the plug receiving portion when the plug terminal is inserted into the plug receiving portion is absorbed. In addition, as viewed from the front, in the electric connector of the invention, since the rising portion and the elastic portion are entirely provided behind the plug receiving portion and nothing is provided on both the lateral external sides of the plug receiving portion, the overall width or lateral dimension of the electric connector can be narrowed. Then, a plurality of electric connectors like this are provided on a substrate in such a manner as to be aligned horizontally, the intervals at which they are so provided can be made small, and hence, the electric connector of the invention is suitable for the miniaturization of electronic equipment in this respect. In addition, since the plug receiving portion is formed into the substantially U-shape or substantially angular U-shape having the opening above the substrate, the electric connector of the invention is suitable for an electric connector into which a plug terminal is inserted into the substrate from above.

According to an aspect of the invention, the lateral dimension of the electric connector can be narrowed. In addition, since the plug receiving portion is formed into the substantially U-shape or substantially angular U-shape having the opening in the parallel direction with the substrate, the electric connector of the invention is suitable for an electric connector into which a plug terminal is inserted in the parallel direction with the substrate.

According to an aspect of the invention, since the second elastic portion is formed at the distal end of the elastic portion in such a manner as to be directed in parallel with the substrate and the plug receiving portion is formed at the distal end of the second elastic portion so formed, the portion that can be twisted and elastically deformed is made to be formed longer by the rising portion, the elastic portion and the second elastic portion, whereby the contact portions of the plug receiving portion can be displaced in the lateral direction more easily.

According to an aspect of the invention, since the part of the elastic portion and the second elastic portion are bent into the substantially S-shape as viewed from the side thereof, the portion that can be twisted and elastically deformed is made to be formed longer, whereby the contact portions of the plug receiving portion can be displaced in the lateral direction more easily.

According to an aspect of the invention, since the second elastic portion which is narrowed in the lateral direction is formed at the distal end of the elastic portion, the contact portions of the plug receiving portion can easily be displaced in the lateral direction by virtue of torsion and elastic deformation of the second elastic portion.

According to an aspect of the invention, since the longitudinal slit is provided in the lateral center of the elastic portion so as to divide the elastic portion into the two elastic pieces, the elastic portion can be twisted and elastically deformed based on each of the elastic pieces, whereby the contact portions of the plug receiving portion can easily be displaced in the lateral direction.

According to an aspect of the invention, since the longitudinal slit is provided in the lateral center of the portion which extends from the rising portion to the elastic portion so as to divide the portion into the two elastic pieces, the portions that can be twisted and elastically deformed are made longer by those elastic pieces, whereby the contact portion of the plug receiving portion can easily be displaced in the lateral direction.

According to an aspect of the invention, since the elastic portion is formed by bending the sheet material at the upper end of the rising portion towards the soldering portion, the elastic portion lies at the end of the soldering portion, whereby the electric connector can be configured which has a small depth.

According to an aspect of the invention, since the projecting portion which projects upwardly is formed at the other end of the soldering portion, the substantially U-shaped or substantially angular U-shaped bottom portion is brought into abutment with the projecting portion when the plug receiving portion is elastically displaced downwards, whereby the downward elastic deformation of the plug receiving portion is restricted, and there is no chance in which a plastic deformation is generated by the excessive elastic deformation.

According to an aspect of the invention, since the projecting portion which projects upwardly is formed at the other end of the soldering portion, and the engagement portion is formed by extending the part of the distal end portion of the plug receiving portion towards the other end and bending the part so extended downwards, the engagement portion is brought into abutment with the projecting portion when the plug receiving portion is elastically displaced towards the one end of the soldering portion to thereby restrict the elastic displacement of the plug receiving portion towards the one end of the soldering portion, and there is no chance in which a plastic deformation is generated by the excessive elastic deformation.

According to an aspect of the invention, since the restricting portions are provided in such a manner as to be brought into contact, respectively, with the outer surfaces of the plug receiving portion or to confront, respectively, the outer surfaces of the plug receiving portion with the space defined therebetween, the substantially U-shaped or substantially angular U-shaped opening of the plug receiving portion is restricted by the abutment of the plug receiving portion with the restricting portions, and there is no chance in which a plastic deformation is generated in the substantially U-shape or substantially angular U-shape of the plug receiving portion by the excessive elastic deformation.

According to an aspect of the invention, since the extended portion is formed at the distal end of the elastic portion in such a manner as to extend towards the other end of the soldering portion in parallel with the substrate to reach above the soldering portion, and the projecting portion which projects upwardly is formed at the other end of the soldering portion, the extended portion is displaced downwards to be brought into abutment with the projecting portion when the plug receiving portion is elastically displaced downwards to thereby restrict the downward elastic displacement of the plug receiving portion is restricted.

According to an aspect of the invention, since the extended portion is formed at the distal end of the elastic portion in such a manner as to extend towards the other end of the soldering portion in parallel with the substrate to reach above the soldering portion, the engagement portion is formed by extending further the part of the distal end portion of the extended portion and bending downwards the part so extended, and the projecting portion which projects upwardly is formed at the other end of the soldering portion, the engagement portion is displaced towards the one end of the soldering portion to be brought into abutment with the projecting portion when the plug receiving portion is elastically displaced towards the one end portion to thereby restrict the elastic displacement of the plug receiving portion towards the one end of the soldering portion.

What is claimed is:

1. An electric connector, comprising:

a soldering portion, to be soldered to a substrate, and extending in a first direction;

a rising portion, one end of which is connected to one end of the soldering portion, and extending in a second direction perpendicular to the first direction;

an elastic portion, one end of which is connected to the other end of the rising portion, and including at least one bending part; and a receiving portion, adapted to receive a plug, and having a U-shape including an open end and a closed end, the open end provided with contact parts which are opposed to each other in a third direction perpendicular to the first and second directions, the closed end connected to the elastic portion, wherein the soldering portion, the rising portion, the elastic portion and the receiving portion are integrally formed with each other.

2. The electric connector as set forth in claim 1, wherein the open end of the receiving portion is opened in the second direction.

3. The electric connector as set forth in claim 2, wherein the closed end of the receiving portion is connected to the other end of the elastic portion, and the other end of the elastic portion extends in the first direction.

4. The electric connector as set forth in claim 3, wherein the elastic portion includes two of the bending parts so as to have an S-shape.

5. The electric connector as set forth in claim 3, wherein a width of the one end of the elastic portion is greater than a width of the other end of the elastic portion in the third direction.

6. The electric connector as set forth in claim 2, wherein the elastic portion is formed with a first slit so as to be divided into two pieces.

7. The electric connector as set forth in claim 6, wherein the rising portion is formed with a second slit connected to the first slit.

8. The electric connector as set forth in claim 2, wherein the elastic portion is disposed between the receiving portion and the rising portion in the first direction.

9. The electric connector as set forth in claim 8, wherein the soldering potion is formed with a projecting part capable of being in contact with the closed end of the receiving portion.

10. The electric connector as set forth in claim 8, wherein the closed end of the receiving portion is formed with an engagement part extending in the second direction, and the soldering portion is provided with a projecting part capable of being in contact with the engagement part.

11. The electric connector as set forth in claim 1, wherein the open end of the receiving portion is opened in the first direction.

12. The electric connector as set forth in claim 11, further comprising:

a restricting portion, having a U-shape covering the receiving portion.

13. The electric connector as set forth in claim 11, wherein the elastic portion is formed with a first slit so as to be divided into two pieces.

14. The electric connector as set forth in claim 13, wherein the rising portion is formed with a second slit connected to the first slit.

15. The electric connector as set forth in claim 11, wherein the elastic portion is disposed between the receiving portion and the rising portion in the first direction.

16. The electric connector as set forth in claim 15, wherein the other end of the elastic portion extends in the first direction, and the soldering potion is formed with a projecting part capable of being in contact with the other end of the elastic portion.

17. The electric connector as set forth in claim 15, wherein the other end of the elastic portion is formed with an engagement part extending in the second direction, and the soldering potion is formed with a projecting part capable of being in contact with the engagement part.

18. A connector unit incorporating a plurality of the electric connector as set forth in claim 1 and arranged on the substrate in the third direction.

* * * * *